United States Patent [19]

Noe et al.

[11] Patent Number: 4,784,099

[45] Date of Patent: Nov. 15, 1988

[54] TIME OPERATED THROTTLE STOP

[76] Inventors: Harley R. Noe, 1845 Lincoln; Warren Bauer, 1680 Sunset Strip, both of Mountain Home, Id. 83647

[21] Appl. No.: 926,580

[22] Filed: Nov. 4, 1986

[51] Int. Cl.[4] ..... F02D 11/08

[52] U.S. Cl. ..... 123/398; 123/401

[58] Field of Search ..... 123/398, 401, 360, 376, 123/378, 332, 333, 198 DB

[56] References Cited

U.S. PATENT DOCUMENTS

| | | | |
|---|---|---|---|
| 2,840,064 | 6/1958 | Hofer | 123/332 |
| 3,517,653 | 6/1970 | Ariga et al. | 123/332 X |
| 3,923,020 | 12/1975 | Gilligan | 123/378 |
| 4,286,685 | 9/1981 | Rudolph et al. | 123/360 |
| 4,362,138 | 12/1982 | Krueger et al. | 123/342 |
| 4,424,876 | 1/1984 | Filho | 123/332 |
| 4,462,372 | 7/1984 | Jackson | 123/452 |
| 4,524,741 | 6/1985 | Corbi | 123/342 |
| 4,574,752 | 3/1986 | Reichert, Jr. et al. | 123/198 DB |

*Primary Examiner*—Tony M. Argenbright
*Assistant Examiner*—Eric R. Carlberg
*Attorney, Agent, or Firm*—Frank J. Dykas

[57] ABSTRACT

A timer operated throttle closing device for drag racing vehicles. In particular, this throttle closing device automatically senses the initiation of the race and automatically closes the throttle after a predetermined period of time has elapsed, and after a second period of time has elapsed automatically releases the throttle closure device.

6 Claims, 2 Drawing Sheets

TIME OPERATED THROTTLE STOP

BACKGROUND OF THE INVENTION

1. Field of Invention

This invention relates to a timer operated throttle closing device for drag racing vehicles. In particular, this throttle closing device automatically senses the initiation of the race and automatically closes the throttle after a predetermined period of time has elapsed, and after a second period of time has elapsed automatically releases the throttle closure device.

2. Description of the Prior Art

Throttle override devices have been developed in the past for the purposes of protecting engines from dangerous conditions such as excessive speed or low engine oil pressure. Hofer U.S. Pat. No. 2,840,064 discloses a device which operates off of a hydraulic servomotor to measure both engine speed and engine oil pressure. Hajime Ariga, et al. U.S. Pat. No. 3,517,653 teaches a device which will selectively interrupt the idle fuel circuit of a carburetor of an engine when the engine is driven by outside inertia such as when coasting down, and also, when the engine is a run on state.

Krueger et al. U.S. Pat. No. 4,362,138 teaches a governor type device which automatically overrides the throttle linkage to reduce the fuel supply to a carburetor for purposes of fuel economy.

In connection with drag racing vehicles Corbi U.S. Pat. No. 4,524,741 discloses a throttle release device for use on drag racing cars to manually set the maximum throttle opening at the commencement of a drag race.

What is needed is a device which automatically overrides manual throttle control to close the throttle for a selected period of time during the drag race.

Controlled drag racing can be briefly described as follows: in drag racing competition is divided into several eliminator categories in which the competition is against a designated index, usually time, in addition to the other vehicle. In Super Gas eliminator this index is 9.90 seconds. The object is to run the course in exactly the index time, every run, and still be the first car across the finish line. Running quicker than the index is called a breakout and results in a loss or being eliminated. This rule keeps competing cars more evenly matched. Most competitors build an engine and chassis combination that is capable of running 0.4 or 0.5 seconds quicker than the index. This results in a harder launch and quicker times at the 60 foot point from the start. Launch and 60 foot times are the major factor in determining the winner of a contest in these elimination races.

To get the car to run the course in exactly the index time, the driver must slow the car down near the end of the track. Various types of throttle stops or restrictor devices have been built. Most operate off of transmission hydraulic pressure to activate a cylinder on the throttle. Usually they are activated when the transmission is shifted into high gear. The throttle is then pulled to some position less than wide open throughout high gear.

The invention herein is for a throttle stop that is activated by a timer adjustable to thousandths of a second. The timer is activated on the launch and can be adjusted from the driver's seat. After activation the timer will activate the hydraulic cylinder on the throttle at some preset time. This activation will last for a period that is also predetermined. The unit will then release the throttle back to the wide open position.

The advantage of this system is that the throttle will not be partially closed all the way through high gear. It would be closed more but at a point closer to the finish line. Also, the system operates on normal compressed air available at any service station.

SUMMARY OF THE INVENTION

Accordingly, it is an object of this invention to provide an automatic throttle stop which will automatically close the drag racing vehicle's engine throttle after a predetermined period of time. Further, it is an object of this invention to be able to release the automatic throttle closing device after a second predetermined period of time during which the drag racing vehicle was slowing down in an attempt to log exactly the same elapsed time on each run.

A third object of this invention is to provide an automatic throttle stop which operates totally independent of the engine oil or hydraulic systems of the race vehicle.

A fourth object of this invention is to provide an automatic throttle stop which allows free use of the throttle during times when it is not activated.

These objects are accomplished by means of a control system which utilizes an independent supply of high pressure air, stored in a tank or hydraulic pressure connected through a solenoid valve to a spring loaded pneumatic cylinder. An inertial switch is provided to sense the initiation of the acceleration at the beginning of the race. When acceleration begins the inertial switch closes and a timer is activated which measures two sequential predetermined periods of time. The driver selects a first period of time which represents the amount of time necessary to traverse some portion of the drag racing course and a second period of time as the amount of time necessary for him to decelerate the vehicle to try and accomplish an exact elapsed time.

The timer sends a signal to a solenoid operated valve which, upon completion of the first period of time, opens to inject high pressure air or oil into the pneumatic cylinder, and at the conclusion of the second period of time turns to a vent position to dump air from the cylinder.

The cylinder is a single action cylinder, and is spring loaded to return it to his original position.

A piston rod connects the internal piston of the cylinder to a chain, which is in turn connected to the control arm of the throttle linkage. Sufficient slack in the chain is provided so that the control arm can be rotated manually by conventional throttle linkage to fully open the carburetor without pulling against the piston rod. The piston rod is designed to have sufficient throw to fully override the slack in the chain so as to close the throttle.

DESCRIPTION OF THE PREFERRED EMBODIMENT

Figure 1:
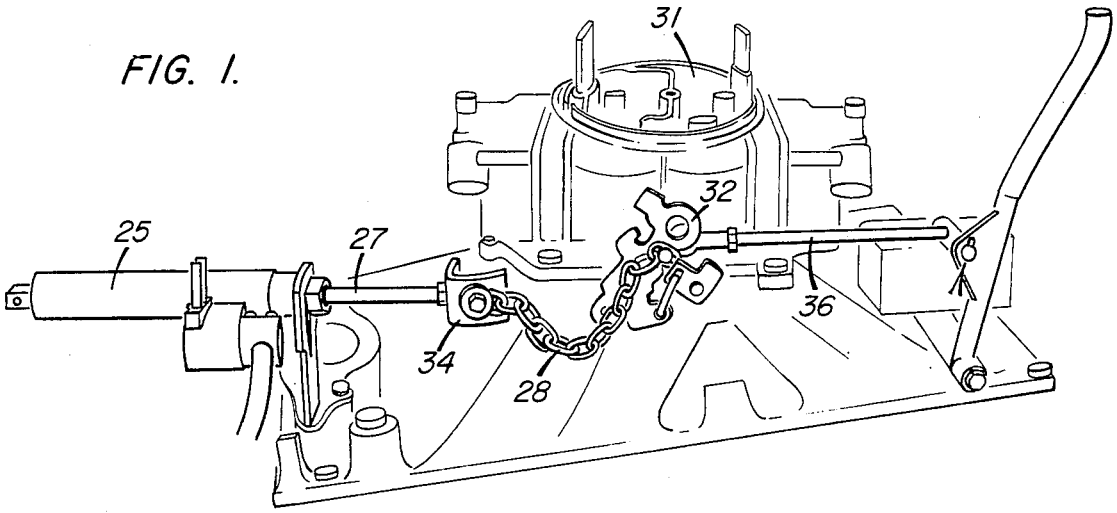
FIG. 1 is a schematic representation of the timer operated throttle closing device.
Figure 2:
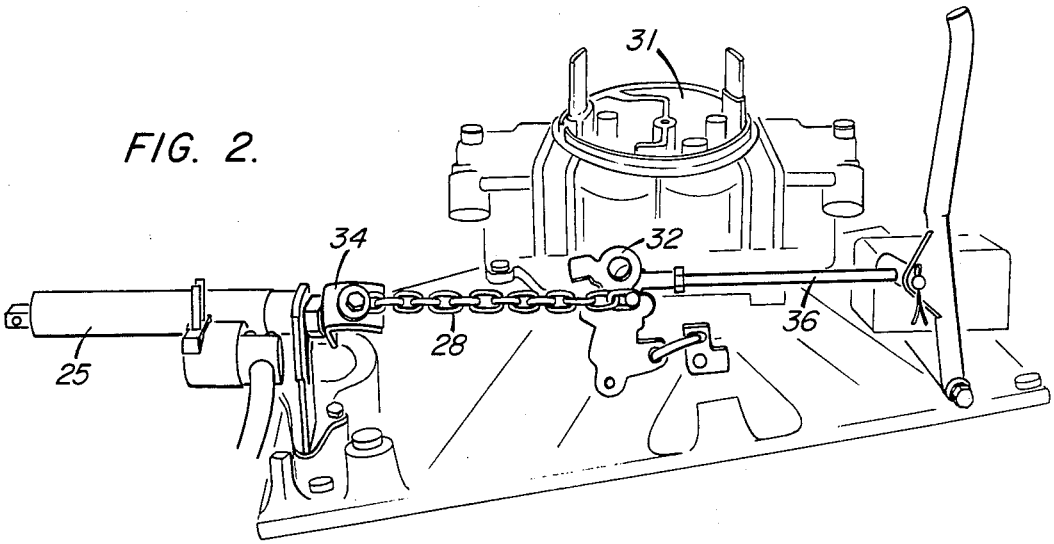
FIG. 2 is a representational side view of the throttle closing device connected to carburetor linkage.
Figure 3:
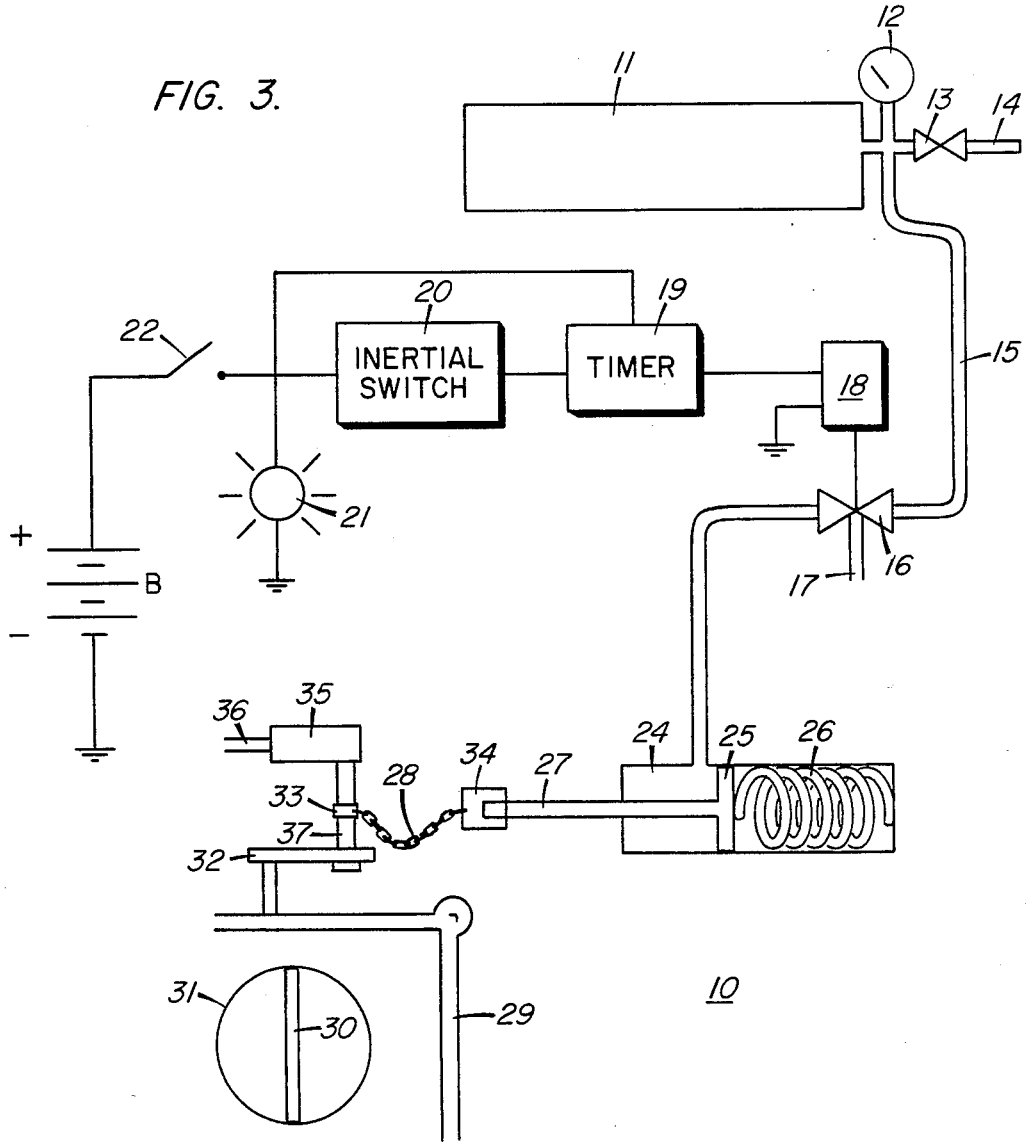
FIG. 3 is a schematic representation of the circuit.

Referring to FIGS. 1, 2 and 3, the automatic throttle control device 10 is shown to advantage. Tank 11 is charged with high pressure air through fill valve 13 and nipple 14. Nipple 14 is similar to a tire valve so that air compressors and hardware utilized for filling vehicle tires can also be used to charge tank 11. Air pressure is monitored by gauge 12. Solenoid operated valve 16 is supplied with high pressure air through airline 15 and is selectively operable to two positions. The first position is where high pressure air supplied from tank 11 and through line 15 and is injected into pneumatic cylinder 24, and the second position is where high pressure air from pneumatic cylinder 24 is vented through vent 17.

Valve 16 is operated by solenoid 18.

When air is injected into pneumatic cylinder 15 it forces piston 25 back against spring 26. This retracts piston rod 27 away from the linkage of carburetor 29, and eventually draws chain 28 taut to pull control pin 37 back thereby rotating control arm 32 to close throttle 30 in carburetor port 31.

Chain 28 is connected to control pin 37 by means of chain ring 33. Sufficient slack in chain 28 is provided so that when throttle linkage 36 is connected by end cap 35 to control pin 37 is drawn in the opposite direction by the driver control arm 32, there is sufficient unrestrictive rotational movement to fully open throttle plate 30.

Solenoid 18 is energized by means of a control system powered by the vehicle battery B. On-off switch 22 and power-on light 21 are provided for energizing the control system immediately prior to the initiation of the race.

Just prior to the commencement of the race the driver turns on on-off switch 22 and presets his desired delay time and his desired activation time. At the initiation of acceleration inertial switch 20 closes providing power to the timer controlled system. Timer 19, at the conclusion of the first elapsed period of time, allows power from the battery to energize solenoid 18, thereby injecting high pressure air from tank 11 into air cylinder 24.

At the conclusion of the second elapsed period of time timer 19 interrupts power to solenoid 18, and valve 16 is then automatically repositioned to vent air from cylinder 24 through vent 17. As air is vented, spring 26 overrides the reduced air pressure, thus forcing piston 25 out of the cylinder which ultimately allows a return of throttle control to the driver.

While there is shown and described the present preferred embodiment of the invention, it is to be distinctly understood that this invention is not limited thereto but may be variously embodied to practice within the scope of the following claims. Accordingly,

What I claim is:

1. A time operated throttle closing device for use on a drag racing vehicle which comprises:

means for selectively closing the throttle of an engine of a drag racing vehicle;

means for selectively deactivating said closing means;

means for sensing the initiation of the acceleration of the drag racing vehicle;

an adjustable timer for measuring a preselected period of time from the initiation of acceleration of the drag racing vehicle;

means for activating the closing means after the predetermined period of time has elapsed.

2. The time operated throttle closing device of claim 1 wherein said means for sensing the initiation of acceleration is an inertial switch.

3. The time operated throttle closing device of claim 1 wherein said means for deactivating said closing means further comprises means for deactivating said closing means after a predetermined, second sequential period of time has elapsed.

4. The time operated throttle closing device of claim 3 wherein said means for closing the throttle of the drag racing vehicle further comprises:

a pneumatically operated cylinder and piston; and a piston rod operatively connecting the cylinder piston to the throttle linkage so as to close the throttle when high pressure air is injected into the cylinder; and spring loading means for returning the piston and piston rod to its original position after the injected air is vented from the cylinder; and a valve connected to the cylinder for selectively injecting high pressure air into the cylinder or venting air from the cylinder; and means for supplying high pressure air to the valve.

5. The time operated throttle closing device of claim 4 wherein the means for supplying high pressure air to the valve further comprises:

a rechargeable high pressure air tank; and piping means connecting said high pressure air tank to the valve.

6. A time operated throttle closing device for use on a drag racing vehicle which comprises:

a pneumatically operated cylinder and piston; and a piston rod operatively connecting the cylinder piston to the throttle linkage of the drag racing vehicle so as to close the throttle when air is injected into the cylinder; and spring loading means for returning the piston and piston rod to its original position after the injected air is vented from the cylinder; and a valve connected to the cylinder for selectively injecting high pressure air into the cylinder or venting air from the cylinder; and a rechargeable high pressure air tank; and piping means connecting the high pressure air tank to the valve; and means for sensing initiation of movement of the drag racing vehicle; and an adjustable timer for measuring first and second, sequential, preselected periods of time from the initiation of acceleration of the vehicle; and solenoid control means for opening the valve to inject air into the cylinder at the conclusion of the first period of time, and for venting the valve to vent air from the cylinder at the conclusion of the second period of time.

* * * * *